United States Patent [19]

Kachelries

[11] 4,345,831

[45] Aug. 24, 1982

[54] AUTOMATIC REFERENCE BACKGROUND MONITORING NETWORK FOR A FILM PROCESSOR

[75] Inventor: Robert W. Kachelries, West Goshen, Pa.

[73] Assignee: E. I. Du Pont de Nemours and Company, Wilmington, Del.

[21] Appl. No.: 136,806

[22] Filed: Apr. 3, 1980

[51] Int. Cl.[3] ..... G03D 13/00

[52] U.S. Cl. ..... 354/298; 354/324; 356/444

[58] Field of Search ..... 354/298, 324; 250/559; 356/443, 444

[56] References Cited

U.S. PATENT DOCUMENTS

| | | | |
|---|---|---|---|
| Re. 30,123 | 10/1979 | Crowell et al. | 137/624.15 |
| B 489,328 | 1/1976 | Takita | 354/298 |
| 2,548,573 | 4/1951 | Wampole et al. | 95/94 |
| 3,462,221 | 8/1969 | Tajima et al. | 355/77 |
| 3,539,085 | 11/1970 | Anderson | 226/25 |
| 3,647,461 | 3/1972 | Surash et al. | 96/66 |
| 3,647,462 | 3/1972 | Surash et al. | 96/66 |
| 3,696,728 | 10/1972 | Hope | 95/89 |
| 3,699,869 | 10/1972 | Jensen | 95/94 |
| 3,752,052 | 8/1973 | Hope et al. | 95/89 |
| 3,774,521 | 11/1973 | Beck | 95/89 |
| 3,787,689 | 1/1974 | Fidelman | 250/219 |
| 3,828,172 | 8/1974 | Schickler | 235/151.12 |
| 3,843,914 | 10/1974 | Carlson et al. | 318/327 |
| 3,930,201 | 12/1975 | Ackermann et al. | 328/1 |
| 4,046,571 | 9/1977 | Mertz | 96/66 |
| 4,057,818 | 11/1977 | Gaskell et al. | 354/298 |
| 4,104,670 | 8/1978 | Charnley | 354/324 |
| 4,135,082 | 1/1979 | Borders, Jr. et al. | 235/92 |
| 4,173,441 | 11/1979 | Wolf | 356/431 |
| 4,174,169 | 11/1979 | Melander et al. | 354/324 |

FOREIGN PATENT DOCUMENTS

| | | |
|---|---|---|
| 1278240 | 9/1968 | Fed. Rep. of Germany . |
| 2004893 | 12/1971 | Fed. Rep. of Germany . |
| 2312517 | 9/1973 | Fed. Rep. of Germany . |

*Primary Examiner*—L. T. Hix
*Assistant Examiner*—W. J. Brady

[57] ABSTRACT

A film processor having film transport rollers driven by a drive motor, a sensor for generating a signal representative of roller transport speed and a film density detector arrangement that includes a photodetector responsive to the intensity of a light source for generating a reference background level signal against which processed film is compared is characterized by a monitoring arrangement which periodically samples the photodetector output signal and adjusts a reference background level signal in accordance with fluctuations in the output of the scanner arrangement. To prevent the system from reacting to momentary perturbations in background level a moving weighted averaging technique is employed. The rate at which the reference background level signal is sampled is determined by the transport roller speed.

14 Claims, 4 Drawing Figures

Fluid Level
Wash
Fixer
Dev. 2
Dev. 1
Blower
Motor
Fixer Repl. Tank
Dev. Repl. Tank
Exit
Calibrate RUN STANDBY
K1 10 20
K2 11 21
FROM PHOTO DETECTORS 64
REF. COUNT
A<B
A=B
A>B
100
106
108
110
112
114
116
118
120
120A
120B
120C
124
126A
126B
126C
128
130
132
134A
134B
134C
136
140
142
144
150
152
152A
152B
154
154A
154B
156
158
160
162
164
166
168
170
172
174
176
178
180
182
146
115
66
78
501
50E 100
102
104
126c
134c
241
267
268
270
272
265
78
50I
266
Calibrate
243
255
253
254
242
229
231B
231
230
245
246
247
248
249
250
251
252
259
260
100
234
233
231A
231C
237
232
236
238
239
144
206
A≤B
A>B
256
56

AUTOMATIC REFERENCE BACKGROUND MONITORING NETWORK FOR A FILM PROCESSOR

BACKGROUND OF THE INVENTION

1. Field of the Invention

This invention relates to film processors having a film density detector arrangement including a light source and a photodetector the output of which is used to generate a reference background level signal against which the transmissivity of processed film is compared and, in particular, to an automatic monitoring arrangement which samples the instantaneous output of the film density detector arrangement as a function of film transport speed and adjusts the reference background level signal to accommodate fluctuations in the output of the film density detector.

2. Description of the Prior Art

Film processors representative of the known art typically include developing, fixing, washing and drying sections through which a film to be processed is transported on an array of transport rollers. The transport rollers are typically driven by a drive motor at predetermined development speed selected so that the film remains within the processor (in particular, the developing section thereof) for a predetermined ideal development time. It is within the developing and fixing sections that the chemical activity generated by the chemical baths disposed within these sections develops and fixes the image on the exposed film. Thereafter, the film is washed and dried prior to its exit from the processor.

During the developing and fixing of the images on the film the constituent chemicals in the developing and processing baths may become depleted. It is, therefore, necessary to periodically replenish the chemicals within these baths in order to maintain their efficacy.

It has been the practice in the art to provide automated developing and fixing chemical replenishment control systems. Such control systems usually include a timing network adapted to control the period during which pumps or other suitable apparatus introduce replenishing supplies of developing and/or fixing chemicals to the baths in order to return the chemical levels within the developing and fixing sections to predetermined concentrations.

The timing network is usually responsive to an initiating signal output from a film density detector. The density detector acts to inspect each processed film at a point just past the drying section and just before the processor outlet in order to obtain an indication of the amount of developing and fixing chemicals used to develop and fix the images on that particular film. The density detector usually operates by generating signals representative of the film's transmissivity which, in turn, is representative of the optical density of the exposed and developed photosensitive layers on the film. The optical film density provides an indication as to the amount of chemical used to develop and fix the image on that film. The information as to the amount of chemical developing and chemical fixing solution utilized is accumulated and, when the accumulated signal exceeds a predetermined threshold, the initiating signal to the timing network is generated.

The density detector typically includes a source of light disposed on one side of the path of the processed film and a photodetector disposed on the opposite side of the film in a position opposite to the light source. The photodetector generates an output signal that is functionally related to the intensity of the light transmitted through the processed film and incident upon the photodetectors. The change in output signal of the photodetectors from a background reference level derived when no film is interposed between the source and the photodetector provides an indication as to the amount of developing and fixing chemicals which are utilized during the processing of the particular film.

The reference background level of the photodetector is established when no film is interposed between the source and the photodetector. Accordingly, the reference background level is related to the intensity of the light source and the sensitivity of the photodetector. Thus, the response when no film is within the device is subject to fluctuations caused by various factors. Over time, factors as line transients, dust, aging, among others, may have the effect of varying the intensity of the light source.

Additionally, some of the more recent film processors are provided with an arrangement whereby the drying section is deenergized and permitted to cool during those periods when no film is being processed within the processor. However, when a film is inserted into the processor it is necessary to again heat up the drying section to the appropriate drying temperature. The temperature excursions imposed upon the density detector arrangement due to its physical proximity to the drying section also have an effect upon the measurement of the density detector output.

The art has recognized the need to periodically monitor the reference background level in order to maintain a calibrated system. The monitoring attempts in the prior art have usually included periodic inspections by maintenance personnel in order to ascertain if deviations from a predetermined reference background level have occurred. The typical response in such an instance is to adjust the gain in the photodetector circuit or, perhaps the intensity of the source, so that the reference background level is restored to the predetermined value. The frequency of such periodic monitoring tasks is unrelated to the operation of the processor and is usually dependent upon the work schedule of the monitoring technician. It is ordinarily not responsive to the relatively short range thermal excursions of the processor.

It is believed to be advantageous to provide an automatic monitoring system adapted to periodically sample and respond to the instantaneous photodetector signal in order to accommodate fluctuations in the density detector arrangement. It is also believed to be advantageous to provide a monitoring system which automatically responds to a measured deviation in the photodetector signal level by adjusting the response to the value of that level, rather than modifying the gain of the photodetector or the intensity of the light source. It is believed to be of further advantage to sample and to respond to the instantaneous photodetector output in accordance with the transport speed of the processor, rather than in accordance with a sampling schedule unrelated to the operation of the processor. It is believed to be of further advantage to respond only to established trends in reference background level and not to minor transients. It would be of still further advantage to implement the automatic monitoring arrangement through the use of a digital computer operating in accordance with its program and most preferably, through the use of a firmware-based microcomputer arrangement.

SUMMARY OF THE INVENTION

This invention relates to a reference background level adjusting network for periodically sampling and adjusting the reference background level signal generated using the output from a photodetector array in a film density detector to accommodate fluctuations in the light source or the photodetector response. The adjusting network includes an adjusted reference background level signal generating network which responds to deviations in the source intensity, as detected by the photodetectors, and/or in the photodetectors, by adjusting the reference background level to a modified value. The intensity of the light source is not altered or restored nor is the sensitivity of the photodetector array. The adjusted reference background level signal is a weighted average of the current reference background signal and a previously-detected reference background signal. The weighted average is generated by appropriately scaled constants selected in accordance with the processing mode of the processor. The film monitoring arrangement includes an enable signal generating network responsive to the transport speed of the processor transport rollers to generate background update enable signals at a frequency related to and dependent only upon processor operation, and not upon factors unrelated to processor operation. Although the invention may be implemented in either a digital or analog hardwire format, the preferred embodiment uses a digital computer operating in accordance with a program, most preferably a firmware-based microcomputer.

BRIEF DESCRIPTION OF THE DRAWINGS

The invention will be more fully understood from the following detailed description taken in connection with the accompanying drawings which form a part of this application and in which.

Figure 3:
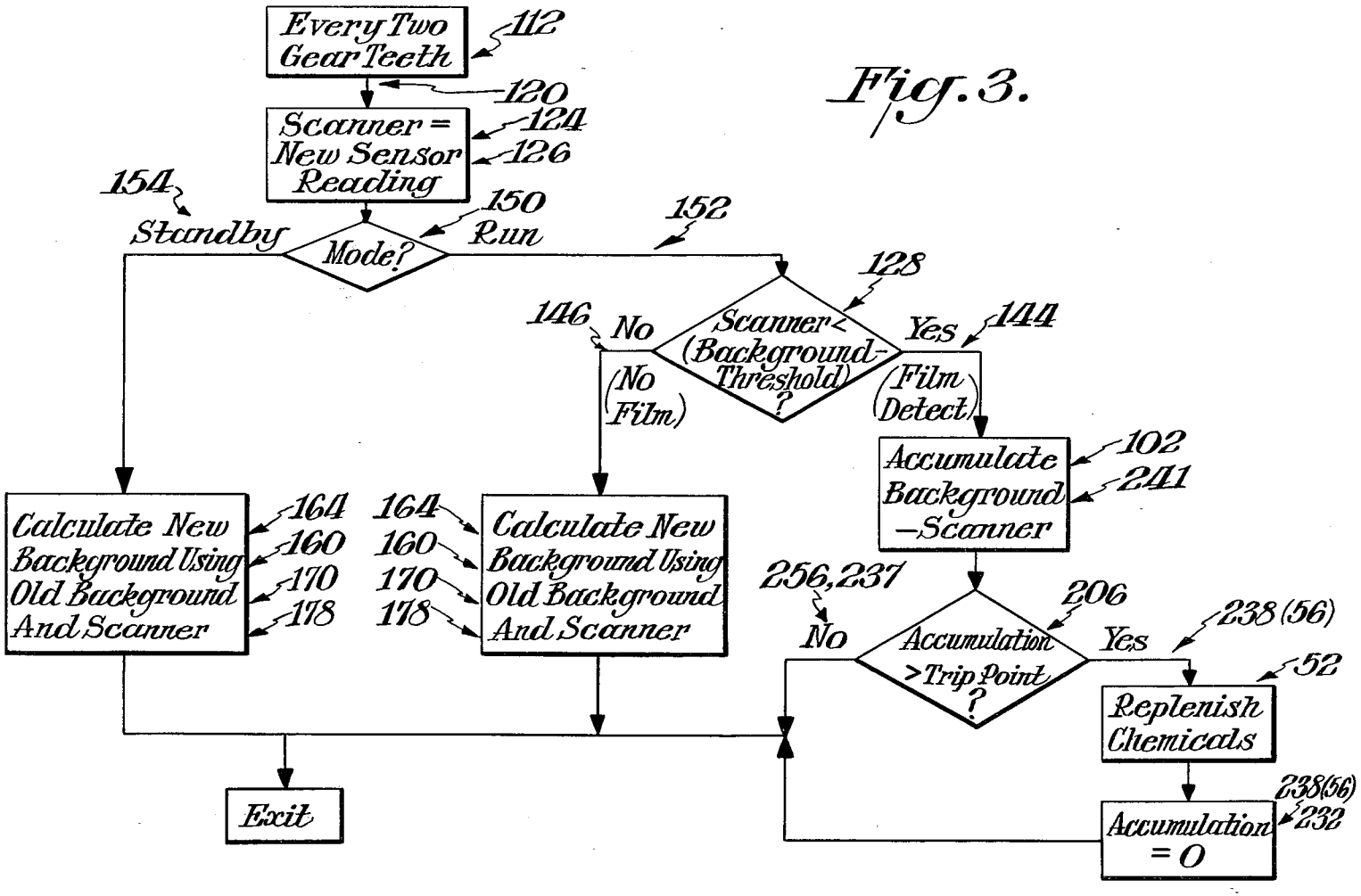
FIG. 3 is a flow chart of a computer program which may be utilized to implement the hardwire circuit diagram shown in FIGS. 2A and 2B through the use of a firmware-based microcomputer arrangement.

The Appendix which is attached to and made part of this application is a listing of a program in conformity with the flow chart shown in FIG. 3.

DETAILED DESCRIPTION OF THE INVENTION

Throughout the following description, similar reference numerals refer to similar elements in all figures of the drawings.

Figure 1:
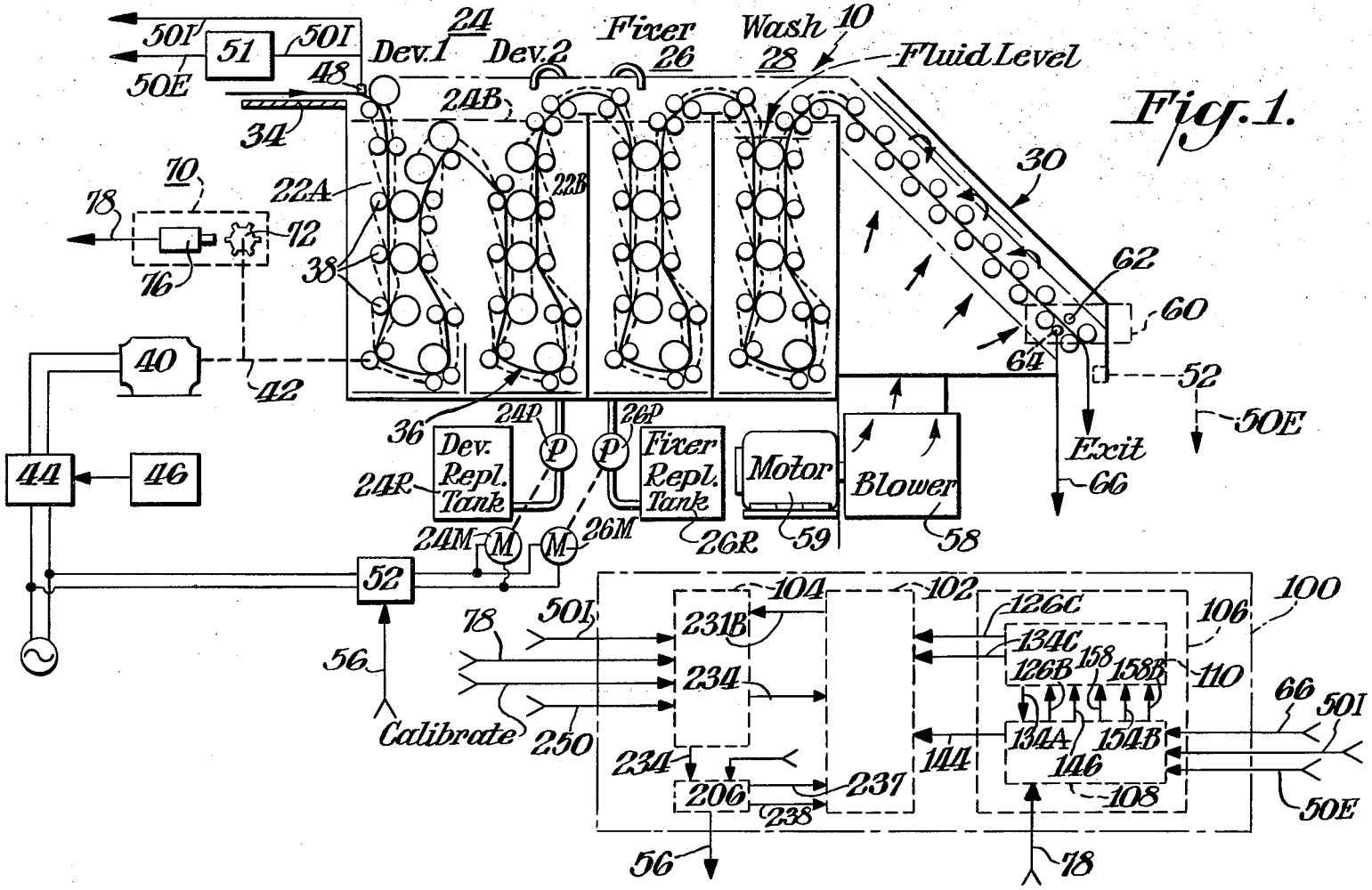
FIG. 1 is a highly stylized pictorial representation of a film processor illustrating the basic operating elements thereof and further illustrating the interconnection of the automated monitoring arrangement therewith.

Referring first to FIG. 1, shown is a highly stylized pictorial representation of a film processor generally indicated by reference numeral 10 and its interconnection with an automatic controller arrangement generally indicated by reference character 100. The controller 100, which is most preferably implemented by a firmware-based microcomputer, includes an accumulator network 102, a calibration network 104 and a photodetector output monitoring network 106, the full details of which are set forth in connection with FIGS. 2A and 2B. The controller 100 is operative to track the reference background level signal and to adjust that signal to compensate for fluctuations due to variations in source intensity or photodetector sensitivity, or for other reasons.

The processor 10 includes coupled development tanks 22A and 22B which cooperate to define a developing section 24, a fixing section 26, a washing section 28 and a drying section 30. Film to be processed is introduced into the processor 10 on a suitable feed table 34 and is conveyed along a generally serpentine path 36 through the developing, fixing, washing and drying sections. The film is carried along the serpentine film path 36 on an array of rotatable transport rollers 38.

The motive power by which the film is transported on the rollers 38 along the serpentine film path 36 is provided by a motor 40 operatively connected through a linkage 42 to the transport rollers 38. The speed at which the film is transported by the rollers 38 through the serpentine film path 36, and particularly through the developing section 24 thereof, is regulated by a motor control circuit 44 operably controlled by an automatic controller generally indicated by reference numeral 46. The details of the automatic controller 46 are disclosed in the copending application of Robert W. Kachelries entitled Automatic Velocity and Position Controller For A Film Processor, filed concurrently herewith.

A film entry switch 48 is located adjacent the feed table 34 and generates a signal on a line 50I representative of the entry of a film into the processor. Circuitry (shown only by the block 51) is provided which generates a signal on a line 50E representative of the exit of the film from the processor. This circuitry 51 is used to generate a signal that is functionally the equivalent of a film exit switch 52 that may be located adjacent the processor exit. The signal lines 50I and 50E are applied to the controller 100. The presence or absence of film within the processor serves to control the state of the processor; i.e., whether it is in the RUN mode or the STANDBY mode. In the STANDBY mode, the drying section 30 is disabled and the motor drive 40 slowed to a predetermined standby speed. In the RUN mode, the drying section is asserted and normal motor speed is applied.

It is within the developing section 24 and the fixing section 26 that the various chemical reactions occur which develop and fix the image on the exposed film. Developing and fixing the exposed film results in a diminution in the level of chemical constituents of developing bath 24B and fixing bath 26B respectively disposed within the developing section 24 and the fixing section 26. The chemical character of the bath is restored to a predetermined reference level by periodically replenishing the developing and fixing liquids from replenishment reservoirs 24R and 26R, respectively. The replenishment liquid from the reservoirs is pumped through appropriate pumps 24P and 26P which derive motive power from associated pump motors 24M and 26M. The motors 24M and 26M are connected to line power through a replenishment control timer arrangement 52 which is operatively controlled by a timer control signal output from the automatic controller 100 on a line 56.

The drying section 30 is heated by a blower 58 which derives motive power from a motor 59 associated therewith.

Located near the exit of the processor within the drying section 30 is a film density detector arrangement generally indicated by reference number 60. The density detector arrangement 60 includes a light source 62 disposed in proximity to one planar surface of the processed film. Mounted oppositely of the source 62 is a photodetector arrangement 64. The output of the photodetector arrangement 64 is applied over a line 66 and is representative of the magnitude of the light energy incident thereon. When no film is interposed between the source 62 and the photodetector 64, the output on the line 66 is representative of a reference background level. When a film is interposed between the source 62 and the photodetector 66, the resultant diminution of the signal output from the photodetector 64 provides an indication of the optical density of the processed film which, in turn, is accumulated to a predetermined value to generate the timer initiation signal. The line 66 is applied as an input to the controller 100.

The speed at which the motor 40 drives the transport rollers 38 may be monitored by a sensor arrangement 70 which includes a toothed wheel 72 operably connected through a connection 74 to the output of the motor 40. Rotation of the toothed wheel 72 provides an indication as to the actual speed of the film transport rollers. The passage of the toothed wheel 72 into proximity with a magnetic pickup (as a zero velocity Hall effect sensor) 76 generates a square wave pulse train which is applied over a line 78 to the controller 100.

Figure 2A:
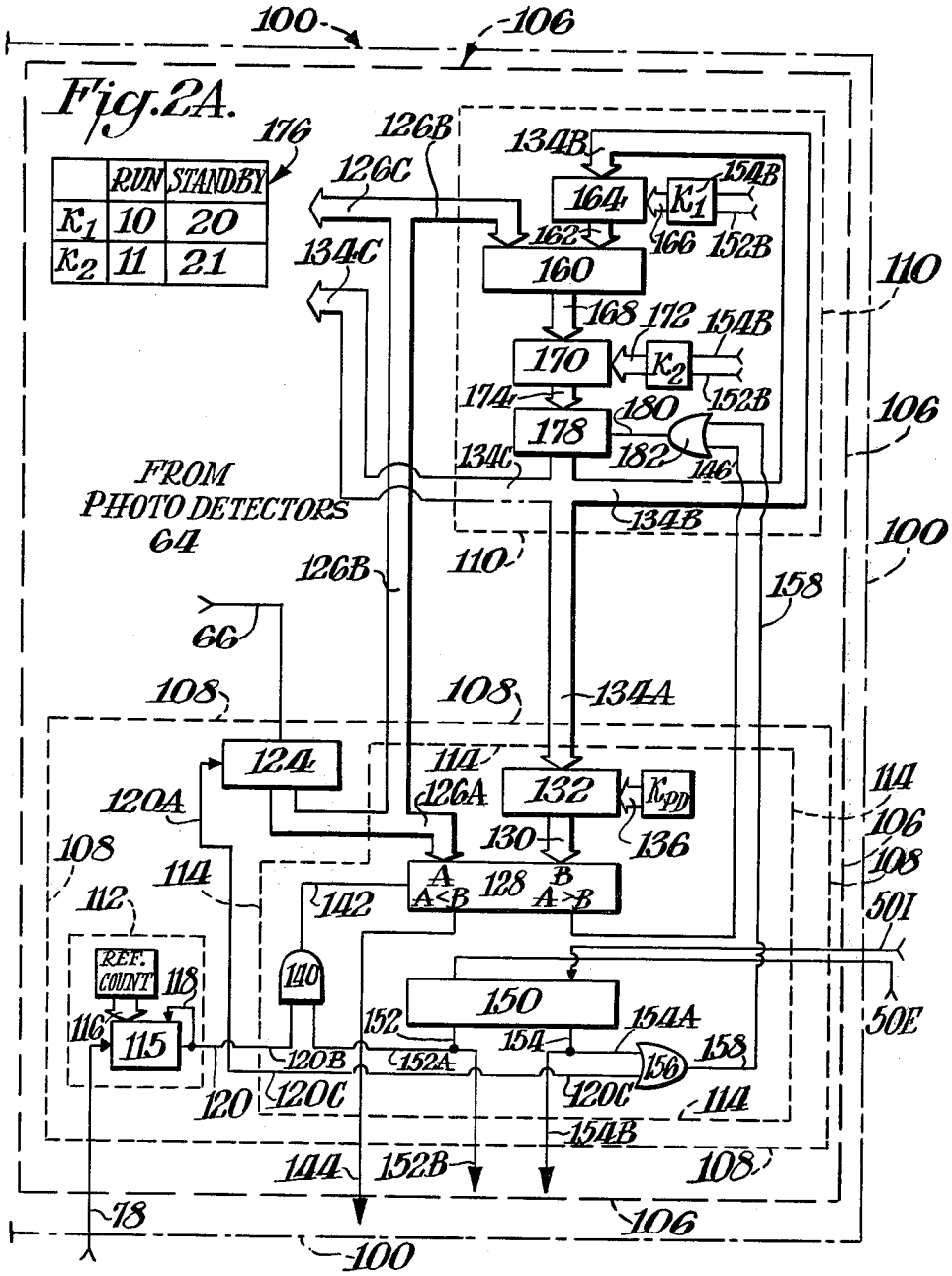
FIGS. 2A and 2B are a hardwire block diagram showing a background monitoring arrangement in accordance with the instant invention.
Figure 2B:
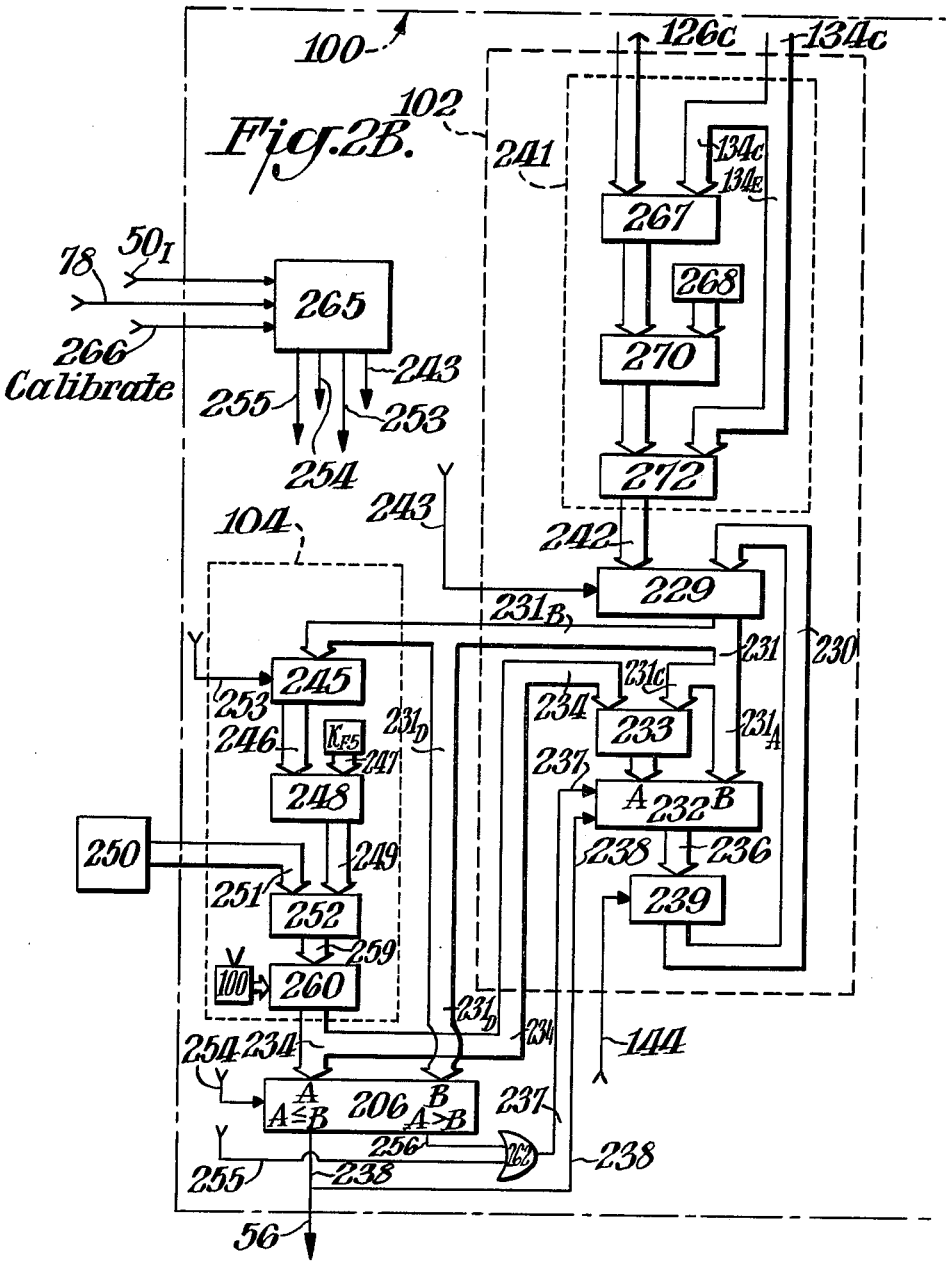

Referring now to FIGS. 2A and 2B, shown is a detailed hardwire diagram of the automatic controller 100. In accordance with this invention, the controller 100 includes the film density detector output signal monitoring network 106 (FIG. 2A), operative to periodically sample and update the photodetector signal during the processor STANDBY and RUN modes to generate an adjusted reference background signal to thus accommodate for fluctuations in the source intensity and photodetector gain. The controller 100 also includes an accumulator network 102 (FIG. 2B) enabled by an output from the network 106 over a line 144 and a calibration network 104 (FIG. 2B). Signals representative of the instantaneous photodetector output on a bus 126C and of the updated reference background level signal on a bus 134C are applied to the accumulator network 102. The output of the controller 100 is applied over the line 56 to the timer control 52.

The film density detector output monitoring arrangement 106 includes an enable signal generating network 108 and an adjusted reference background signal generating network 110.

The enable signal generating network 108 includes a sample rate signal generator 112 and a background update signal generator 114. The sample rate signal generator 112 serves to generate the basic timing signals used in the system, these timing signals being generated in accordance with rate of rotation of the film transport drive rollers as determined by the speed of the transport motor drive. The background update signal generator 114 serves to generate background update signals which are applied to enable the adjusted background signal generating network 110 and to generate film detect signals which disable the network 110 and enable the accumulator network 102.

The transport rollers rotate in accordance with the speed of the transport drive motor 40. A signal representative of the transport roller speed is derived from the output of the sensor arrangement 70. The electrical signal representation of the transport roller speed is applied over the line 78 to the monitoring network 106 and specifically to a down counter 115 included within the sample rate signal generator 112. The counter 115 is applied with a reference count over a four-bit data bus 116. Whenever one of the teeth of the gear wheel passes in proximity to the sensor 76, a square wave pulse is output from the sensor and is applied to the counter 115. The counter decrements by one for each pulse received until it counts from the reference count to zero. Upon reaching zero count a signal output is generated and applied over lines 120 to the circuitry within the network 106 and which also resets the counter 115 over a line 118 with the reference count. The sample rate signal on the lines 120 is basically a representation of film transport distance, as derived from the gear tooth sensor. The pulse rate on the lines 120 is equal to the pulse rate of the output signal from the sensor divided by the reference count. The value of the reference count is, of course, selectable. Suitable for use as the counter 115 is a device manufactured by any of a number of component manufacturers (such as Texas Instruments, Signetics, Fairchild, Analog Devices, and Motorola) and sold under component number 74193. Hereinafter, where component numbers are provided, it is to be understood that the device may be obtained from any of the manufacturers listed above, among others. As is known to those skilled in the art, a number of such devices may have to be combined to produce the desired function depending upon the number of bits, etc.

The sample rate signal from the generator 112 is applied over the line 120A to enable an analog-to-digital converter 124. Suitable for use as the converter 124 is a device available from Analog Devices under component number AD571. The converter 124 is input with the analog signal output from the photodetector over the line 66. When enabled by the sample signal on the line 120A, the converter 124 is operative to generate a digital representation of the output signal from the photodetector at that instant. The digital representation of the photodetector output signal is applied over a ten-bit data bus 126A to the background update signal generator 114. The instantaneous photodetector output signal is also applied over the bus 126B to the adjusted background signal generating network 110 and over the bus 126C to accumulator network 102.

In the background update signal generator 114, the digital representation of the instantaneous photodetector output signal on the bus 126A is applied to the "A" inputs of a digital comparator 128. The "B" inputs to the comparator 128 are connected to a sixteen-bit bus 130 at the output of a digital subtractor 132. The subtractor 132 serves to define a film-detect threshold equal to the previously stored background reference level (applied to the subtractor 132 over a sixteen-bit data bus 134A), reduced by the value of a product-detect constant $K_{PD}$ applied to the subtractor 132 over a five-bit bus 136. The value of the constant $K_{PD}$ is selectable. Suitable for use as the comparator 128 is a component sold under model number 7485, while the subtractor may be implemented by a device sold under model number 74181.

The comparator 128 is enabled by the output of a gate 140 applied on a line 142 output therefrom. One of the inputs of the gate 140 is derived from the output of the sample rate generator 112 over the line 120B. The "less than" output of the comparator 128 is applied by a line 144 to the accumulator network 102. As is discussed herein, the signal on the line 144 is representative of the presence of a film interposed between the source and the photodetector. The "greater than" output of the comparator 128 is applied over a line 146 to the adjusted background signal generating network 110 and, as will be developed herein, a signal on the line 146 serves as an update enabling signal for the generation of an adjusted background reference signal.

An up/down counter 150 (such as a device sold under model number 74193) serves as a processor operating mode indicator. The counter 150 is incremented by the presence of a signal on the line 50I from the film entry switch. The occurrence of a film exit signal on the line 50E serves to decrement the counter 150. Thus, as long as a film is within the processor, the output of the counter 150 is a value other than zero and a signal is present on the line 152. The presence of the signal on the line 152 indicates the processor is in the RUN mode. This signal is applied over the line 152A as the second input to the AND gate 140 and over a line 152B to the adjusted reference background signal generating network 110. Once all film exits the processor, the value of the counter 150 reverts to zero value. This condition generates a signal on the 154 indicative of the STANDBY processor mode. The line 154 branches and is applied on a line 154A as the first input to an AND gate 156 and a line 154B to the network 110. The other input to the gate 156 is derived from the output of the sample rate generator 112 over the line 120C. The output of the gate 156 is applied over a line 158 as an update enabling signal to the adjusted reference background signal generating network 110. Suitable for use as the AND gates 140 and 156 are devices sold under model number 7408.

The adjusted reference background signal generating network 110 includes an adder 160 which receives as one input the digital representation of the instantaneous photodetector output signal applied over the bus 126B. The other input to the adder 160 is obtained from a sixteen-bit bus 162. The signal on the bus 162 is generated by a multiplier 164. The multiplier 164 scales a previously stored background signal applied over the bus 134B. The scaling factor $K_1$ is applied over a five-bit bus 166. The value of the scaling factor $K_1$ is selected according to the mode of the processor, either RUN mode or STANDBY mode, information indicative of which is applied over lines 152B and 154B, respectively. Suitable for use as the adder 160 is a device sold under model number 74181, while the multiplier may be implemented using a device sold under number 74S274.

The output of the adder 160 is applied over a sixteen-bit bus 168 to a divider 170, as a device sold under model number 74198. In the divider 170, the sum of the instantaneous photodetector output signal and the scaled value of the stored background reference signal is divided by a constant $K_2$, applied over a five-bit bus 172. $K_2$ is selected in accordance with the mode of the processor, as indicated by the signals on the lines 152B and 154B. By summing the instantaneous photodetector output signal with a scaled stored background reference by the constant $K_1$, and then dividing by the constant $K_2$, a modified, moving average reference background signal is generated and presented on a sixteen-bit bus 174 connected to the output of the divider 170.

The constants $K_1$ and $K_2$ are related. If the constant $K_1$ is assigned a value of N, the constant $K_2$ equals the value (N+1). Typical values for the constants $K_1$ and $K_2$ in the RUN and STANDBY modes are indicated in the table indicated at reference character 176 in FIG. 2.

The adjusted background reference signal on the bus 174 is stored in a latch 178, such as a device sold under model number 7475. The latch 178 is enabled by an output line 180 emanating from an OR gate 182, such as a device identified by model number 7432. The inputs to the gate 182 are the update enabling signals on the lines 146 and 158. The adjusted, updated reference background signal value stored at the output of the latch 178 is furnished to several locations; over the bus 134A to the subtractor 132, fed back over the bus 134B to the multiplier 164, and applied to the accumulator network 102 over the sixteen-bit bus 134C.

In operation, if the processor operates in the STANDBY mode, each passage of a number of teeth, equal to the reference count, generates a sample pulse on the lines 120 which is simultaneously applied over the lines 120A, 120B and 120C to enable the analog-to-digital converter 124 and generate an update enable signal on the line 158. (Since the processor is in the STANDBY mode, the output of the counter 150 on the line 152 is not asserted, thus disabling the gate 140 and rendering the signal on the line 120B ineffective.) With the converter 124 enabled, the instantaneous value of the photodetector output signal level on the bus 126B is applied to the adder 160, where it is averaged by summing it with the scaled value of the previously stored reference background signal and dividing the sum by the divider 170. The updated, moving average reference background level signal is applied to the latch 178. The scaling constant $K_1$ and the constant $K_2$ are selected in accordance with the signal on the line 154B. Since the latch 178 is enabled by the gate 182 (due to the presence of the signal on the line 158 from the gate 156), an adjusted, updated reference background signal is applied over the bus 134. Thus, in the STANDBY mode, for each predetermined number of teeth that pass the sensor 70, the instantaneous photodetector output is periodically sampled and an updated, averaged reference background level signal is generated to compensate for fluctuations in source intensity or in photodetector sensitivity.

When film enters the processor, the line 152 from the counter 150 is asserted (indicative of the RUN mode), enabling the 140, which upon the occurrence of the sample rate signal on the line 120B, enables the comparator 128. The instantaneous photodetector output signal sampled when the converter 124 is enabled on the line 120A is applied to the "A" inputs of the comparator 128 and compared to the last previous reference background, adjusted downwardly by the subtractor 132 and present on the bus 130. (Since the processor is in the RUN mode, the gate 156 is disabled.).

So long as the film is not interposed between the source and the photodetector, the instantaneous photodetector output signal (on the "A" input) is likely to exceed the reduced "threshold" value provided on the "B" input to the comparator 128. Thus, an output signal on the line 146 enables the gate 182 and the background reference is adjusted in the manner discussed in connection with the description of the STANDBY mode. However, when the film is transported to a position where it is interposed between the source and the photodetectors, a decrease in the instantaneous photodetector output signal drives the "A" input below the signal value from the comparator 128. A signal on the line 144 is applied to the accumulator network 102 indicating the presence of film in the scanner 60 and enabling the operation of the accumulator 102. Since the signal on the line 146 is not asserted, and since the gate 156 is disabled during the RUN mode, further updating of the background reference signal is not permitted when a film is detected in the scanner.

Referring now to accumulator network control 102, the instantaneous photodetector output signal on the bus 126C is input to a normalizing network 241 (discussed herein) together with the output signal from the adjusted reference background signal generator 110 carried on the bus 134C. The output of the normalizing network 241 is applied on a sixteen-bit bus 242 to an adder 229 (such as a device sold under model number 74181) where it is added to the value appearing on a thirty-two bit bus 230. The adder 229 is a thirty-two-bit adder which adds the difference between the adjusted reference background level on the bus 134C and the instantaneous photodetector output signal on the bus 126C to the old accumulation carried on the bus 230.

The output of the adder 229 appears on a thirty-two-bit bus 231 and is applied to the "B" input terminal of a multiplexer 232 (on a bus 231A), to a latch 245 in the calibration network 104 (on a bus 231B), and to one input terminal of a subtractor 233 (on a bus 231C). The other input to the subtractor 233 is applied on a thirty-two-bit bus 234 which contains the current trip point adjusted to a previous calibration. The output of the subtractor 233 is carried on a thirty-two-bit bus 235 and is applied to the "A" input terminal of multiplexer 232. Suitable for use as the multiplexer 232 are combinations of devices sold under model numbers 7408 and 7432, while the latch may be implemented using devices sold under model number 7475. Devices sold under model number 74181 may be used as the subtractor 233.

Whenever there is a signal on a line 237 the multiplexer 232 passes the value appearing at its "B" input terminal to a thirty-two-bit bus 236. Alternately, a signal on the line 238 causes the multiplexer 232 to transmit the value at its "A" input terminal to the bus 236. The new accumulation reading appearing on the bus 236 is stored in a latch 239 (as a device sold under model number 7475) enabled by a film detect signal appearing on the line 144.

The function of the accumulator network 102 is to perform a summation of the difference between the average reference background signals and the instantaneous signals from the photodetectors 64 as the film passes between the source 62 and the photodetectors 64. Summing is continued until its result is greater than the trip point. At this time the adjusted trip point is subtracted from the summation result and the summing starts over at this new value.

The output of the adder 229, which appears on the bus 231B is applied to the calibration network 104. The calibration network 104 is used for calibrating the film density detector system. The input on the bus 231 is applied to the latch 245 which is used to store the calibration result when the signal on a line 253 is asserted. The calibration result remains unchanged until the next film density detector system recalibration. The output of the latch 245 is applied to a multiplier 248 (such as that sold under model number 74274) on a thirty-two-bit bus 246. In the multiplier 248, the latch output is multiplied by a predetermined constant $K_{FS}$ applied over a four-bit bus 247. Typically the constant $K_{FS}$ has a value of two and is used to determined the full scale value. The output of the multiplier 248 is applied on a thirty-two-bit bus 249 to a multiplier 252, such as the device sold under model number 74S274, where it is multiplied by the accumulation trip point signal 250 appearing on a seven-bit bus 251. The accumulation trip point, representing a percentage factor, having a value ranging between ten and ninety-nine is operator selectable. The output of the multiplier 252 is applied on a thirty-two-bit bus 259 to a divider 260, where it is divided by a predetermined value, such as one hundred. The output of the divider 260 (which may be implemented using a device sold under model number 74198) is applied to the bus 234.

The operation of the calibration network 104 may be better understood in relation to the following example. A signal to start calibration applied on the line 243 clears the adder 229 in the accumulator network 102 which initializes the summation at zero. As long as the controller is in the calibrating mode (indicated by the presence of a signal on the line 255), the multiplexer 232 is directed to use the value of the signal at its "B" input. The controller will remain in the calibration state until a signal to end calibration is applied on a line 253 which causes the value of the summation to be stored in the latch 245. The controller is designed such that the value stored in the latch 245 represents the mid-range value of the accumulation trip point scale. Consequently, when the value on the latch 245 is multiplied by the constant $K_{FS}$ by the multiplier 248, the output on the bus 249 represents full scale. The effect of the next multiplication and division by the elements 252 and 260, respectively, is to take the desired accumulation trip percentage value entered applied typically from the numeric keypad or a thumbwheel setting over the bus 251 and produce an adjusted trip point value. This adjusted trip point value is then applied to the "A" input terminal of a comparator 206, while the output of the adder 229 is applied to the "B" input terminal over a line 231D. The comparator 206 (such as a device sold under model number 7485) is enabled only when the controller is not in the calibration mode. The output of the comparator 206 appears on the lines 256 and 238. The signal on the line 238 has a true state when the "A" input value is less than or equal to the "B" input value; that is, when the accumulation value generated by the accumulator network 102 has exceeded the adjusted trip point value. The other output on the line 256 has a true state when "A" is greater than "B"; that is, when the adjusted trip point value exceeds the accumulation value. This logic value signal is applied to the OR gate 262 (such as a device sold under model number 7432). The output of the OR gate 262 on the line 237 is true whenever the signal on the line 256 is true or when the signal on the line 255 is true, and directs the multiplexer 232 to use the value appearing at its "B" input terminal. The signal on the line 238 from the comparator 206 is also applied to the timer 52 on the line 56 to run both the developer replenishment pump 24P and the fixer replenishment pump 26P for the durations entered by an operator. The signals on the lines 243, 253, 254 and 255 are derived from a network 265 which, in response to operator input commands on the line 266, the film entry signal on the line 50I, and the signal on the line 78, generates signals representative of the start (line 243) and the stop (line 253) of the calibration cycle, and signals (on lines 254 and 255) representative of the assertion of the calibration mode.

To summarize, the controller 100 is used to determine the amount of optical density of the processed film that has passed through the film density detector while guaranteeing that changes in the background light level have not affected the ability of the film density detector system to measure film optical density and to prevent the system from reacting to momentary perturbations in background levels. As an example, if the reference background level is at the predetermined maximum (one thousand) if it is assumed that the film will cause the analog-to-digital converter 124 to output a level of five hundred for the entire length of the film, or fifty percent of the reference background indicating a transmissivity of fifty percent. Then for the same piece of film, should the reference background level fall to a value of nine hundred, the output of the converter falls to four hundred fifty over the entire length of the film, which still represents fifty percent transmissivity. The difference of four hundred fifty is normalized on a basis of the one thousand maximum, yielding a normalized transmissivity of five hundred, which is the same as occurred when the reference background level is at its maximum. Therefore, even though the reference background level is changed, the accumulation is not affected by this change.

The normalization is achieved in the normalizing network 241 by subtracting the instantaneous photodetector on the bus 126C from the background reference level on the bus 134C in the subtractor 267 and multiplying the result by the maximum value 268 of the background in a multiplier 270. This result is divided by the reference background signal derived from the bus 134E by a divider 272, yielding the normalized transmissivity on the bus 242 based on the current background level. Suitable for use as the subtractor 242 is a device sold under model number 74181. The multiplier 270 may be implemented by a device sold under model number 74274 while the divider 270 may be a device sold under model number 74198.

In addition to the background monitoring and the accumulation circuitry, a self-calibration circuit may be activated upon command by the operator for a designated sheet of film as it is fed into the processor. After the film has traveled through the entire length of the machine, its density is measured by the density detector 60. When the leading edge of the film reaches the density detector, the start-calibration signal is energized and thereby initiates the calibration process which is simply a separate accumulation only relative to current background. When the trailing edge of the film sheet reaches the density detector, the end-calibration signal is triggered and this causes the current summation value from the adder 229 to be stored in the latch 245. This value represents the midpoint on the calibration scale and is calculated independently of the current background. It thus represents the total accumulation obtained from the piece of film entered. Should the light level in photodetectors 64 change slightly due to temperature or surface or bulk deposits, or for any other reason that would cause it to fluctuate in intensity, then these variations, although ignoted by the accumulation circuitry, would be monitored by the reference background level monitoring circuitry 106. As long as the output from the photodetectors is linear, or compensated to be linear, with respect to the amount of blockage of light due to the film optical density (or transmissivity), then only little, if any, loss of accuracy due to slow fluctuations in the background level should occur.

In reference to self-calibration, it is necessary to define for the controller the 0.5 reading on the accumulation trip-point scale. To do this, the operator instructs the controller to do a calibration on the density detector. The controller then requests the operator to insert the calibration film. The calibration film is a sixteen by twenty-four inch, totally exposed sheet of film. This film travels through the machine to the density detector. At this time, the old accumulation data is reset to zero and the new integration starts. This integration continues for the entire length of the film. When finished, the trip-point scale is adjusted so that the final accumulation of the calibration film is equal to 0.5 of the trip-point scale.

Although the invention may be implemented in either analog or digital modes and in either hardwire circuitry or program controlled circuitry the best mode contemplated for the implementation of the instant invention is a firmware-based microcomputer. Suitable for use as the controller 100 is a single board computer such as that manufactured by Intel sold under model number SBC 8005 that includes a central processor unit such as an Intel 8085 single chip eight-bit-N channel microprocessor, a system clock, a random access memory such as that manufactured by Intel and sold under model number 5101, a read-only memory such as that manufactured by Intel, and sold under model number 2716, input-output ports, a programmable timer, an interrupt and bus control logic adapted to control the flow of information between the above-recited constituent elements of the microcomputer. Extended memory capability may be provided on a separate printed circuit board on which is also disposed the random access memory, the read-only memory as well as the bus control logic.

The architecture of the microcomputer utilized is configured in accordance with the principles set forth in the documentation supplied by the manufacturer of the single board computer and microprocessor chip along with vendor's product specifications. These materials include: (1) the TTL Data Book for Design Engineers, Second Edition, Texas Instruments, 1976; (2) RCA Solid State 1974 Data Book, Series SSD-201B, Linear Integrated and MOS Devices Selection Guide Data, RCA, 1973; and (3) Intel Component Data Catalog, Intel Corporation, 1979.

With reference to FIG. 3, shown is a flow chart of a program in accordance with which the microcomputer may implement the functions discussed above in connection with the generalized block diagram of FIGS. 2A and 2B. The flow chart of FIG. 3 is also keyed by the appropriate reference numerals to indicate the function performed in the microcomputer corresponding to the hardwire components shown in FIGS. 2A and 2B. A listing of a program in accordance with the flow diagram of FIG. 3 is appended to and made part of this application.

In view of the foregoing, it should be appreciated that, in accordance with the instant invention, the reference background may be updated to accommodate fluctuations in source intensity without the gain of the necessity of operator intervention in adjusting the photodetector or the source intensity to a predetermined level. The updated background reference level is used as the standard against which the film transmissivity is judged. The adjustment to the reference level may be accomplished at a sample rate in accordance with predetermined increments in the film travel, as derived from a sensor geared to the transport drive. The background reference adjustments occur at the predetermined sample rate during the STANDBY mode, and up to the time a film is interposed between the source and the photodetectors while in the RUN mode. As noted, the invention is most preferably implemented by a firmware-based microcomputer arrangement.

The invention may be implemented and practiced by those skilled in the art using alternative embodiments disclosed or suggested by the above disclosure. It is to be understood that such alternative embodiments are construed to lie within the contemplation of the instant invention, as defined in the appended claims.

```
/*********************************************************************
********** SCANNER CONTROL (DENSITY CALCULATION) ********************
*********************************************************************/

250  1   RUN$PUMPS: PROCEDURE PUBLIC;
251  2     HIGH$ACCUM = 0;      /*RESET ACCUMULATION SUMMER */
252  2     IF (FILM$TYPE(CURRENT).FIX$REPL$TIME <> 0 ) THEN
253  2     CALL  ADD$TO$FIXER$PUMP$TIME(FILM$TYPE(CURRENT).FIX$REPL$TIME,1);
254  2     IF (FILM$TYPE(CURRENT).DEV$REPL$TIME <> 0 ) THEN
255  2     CALL  ADD$TO$A$B$PUMP$TIME  (FILM$TYPE(CURRENT).DEV$REPL$TIME,1);
256  2   END RUN$PUMPS;


257  1   TAKE$SCANNER$READINGS: PROCEDURE PUBLIC;
258  2     CALL  READ$A$TO$D(SCAN$A$D);
259  2     IF CALIBRATION$ACTIVE THEN
260  2       DO;
261  3         CALL  ADD$TO$ACCUM;
262  3       END;
         ELSE
263  2       DO;
264  3         IF FILM$COUNT = 0 THEN        /* IS THERE FILM IS THE MACHINE? */
265  3           DO;                         /* NO - THEN CALCULATE BACKGROUND */
266  4             BACKGROUND = ((BACKGROUND * 10) + ANALOG$VALUE) / 11;
267  4             IF BACKGROUND > BAD$SCANNER$THRESHOLD THEN
268  4               DO;
269  5                 CALL  WARN$OFF(WARN$SCANNER);
270  5               END;
271  4           END;
           ELSE
272  3           DO;                         /* THERE IS FILM IN THE MACHINE   */
273  4             CALL  ADD$TO$ACCUM;       /* ADD TO ACCUMULATION            */
274  4             IF (HIGH$ACCUM >= ACTUAL$TRIP$POINT) THEN
275  4               DO;
276  5                 CALL RUN$PUMPS;
277  5               END;
278  4           END;
279  3       END;
280  2     IF  BACKGROUND <= BAD$SCANNER$THRESHOLD THEN
281  2       DO;
282  3         CALL  WARN$ON(WARN$SCANNER);            /* SCANNER LIGHT IS OUT.*/
283  3       END;
284  2     RETURN;
285  2   END TAKE$SCANNER$READINGS;
```

```
        /*****************************************************************
        ********** READ AN A/D VALUE ***************************************
        *****************************************************************/

191  1  READ$A$TO$D: PROCEDURE (ADDR) PUBLIC;
192  2    DECLARE (ADDR, GO$ON, HIGH$A$D, ABORT$COUNT) BYTE;

193  2    OUTPUT (A$D$MUX$PORT) = ((ADDR AND 3) OR 4);
194  2    GO$ON = FALSE;
195  2    ABORT$COUNT = 16;          /* ABORT AFTER 16 TIMES THRU */
196  2    DO WHILE (GO$ON = FALSE) AND (ABORT$COUNT <> 0);
197  3      IF ((INPUT(BULK$ADD$PORT) AND A$D$DONE) = 0) THEN  GO$ON = TRUE;
199  3      ELSE  ABORT$COUNT = ABORT$COUNT - 1;
200  3    END;
201  2    IF ABORT$COUNT = 0 THEN
202  2      ANALOG$VALUE = ANALOG$ABORT;
             ELSE
203  2      DO;
204  3        HIGH$A$D = (INPUT(A$TO$D$HIGH$PORT) AND (A$D$HIGH$MASK));
205  3        ANALOG$VALUE = SHL(DOUBLE(HIGH$A$D), 8) + INPUT(A$TO$D$LOW$PORT);
206  3      END;
207  2    RETURN;
208  2  END READ$A$TO$D;

        /*****************************************************************
        ********* ADD TO ACCUMULATION (DOUBLE PRECISION ADDITION) ***********
        *****************************************************************/

209  1  ADD$TO$ACCUM: PROCEDURE;
210  2    IF (BACKGROUND > (ANALOG$VALUE + BACKGROUND$THRESHOLD)) THEN
211  2      DO;                                  /* THEN IT IS LOW ENOUGHT */
212  3       LOW$ACCUM=LOW$ACCUM+(((BACKGROUND-ANALOG$VALUE)*10)/((BACKGROUND+5)/10))*10;
213  3         IF LOW$ACCUM >= 1000 THEN
214  3           DO;
215  4             LOW$ACCUM = LOW$ACCUM - 1000;
216  4             HIGH$ACCUM = HIGH$ACCUM + 1;
217  4           END;
218  3      END;
             ELSE
219  2      DO;
220  3        BACKGROUND = ((BACKGROUND * 20) + ANALOG$VALUE) / 21;
221  3      END;
222  2    RETURN;
223  2  END ADD$TO$ACCUM;

        /*****************************************************************
        ********** CALIBRATION CONTROL ROUTINES ****************************
        ********** CALLED VIA THE SCHEDULER ********************************
        *****************************************************************/

286  1  CALIBRATION$START: PROCEDURE PUBLIC;
287  2    CALIBRATION$ACTIVE = TRUE;          /* TURN ON CALIBRATION */
288  2    HIGH$ACCUM = 0;                     /* RESET SUMMER        */
289  2    LOW$ACCUM  = 0;                     /* RESET SUMMER        */
290  2    RETURN;
291  2  END CALIBRATION$START;
```

```
292  1   CALIBRATION$END: PROCEDURE PUBLIC;
293  2     CALIBRATION$ACTIVE = FALSE;          /* TURN OFF CALIBRATION */
294  2     ANALOG$VALUE = 500;                  /* GET READY FOR ROUND  */
295  2     CALL  ADD$TO$ACCUM;                  /* ROUND OFF THE ACCUM  */
296  2     CALIBRATION$POINT  = HIGH$ACCUM;     /* SAVE CALIBRATION PNT */
297  2     HIGH$ACCUM = 0;                      /* RESET ACCUMULATION   */
298  2     LOW$ACCUM  = 0;                      /* RESET ACCUMULATION   */
299  2     RETURN;
300  2   END CALIBRATION$END;

         ******************************************************************
         ********** NOTE:  THE TWO PUMPS (A + B) AND (A + E) ARE MUTUALLY *****
         **********        EXCLUSIVE, THEREFORE THEY CANNOT RUN AT THE ********
         **********        SAME TIME.  THE TWO ROUTINES BELOW *****************
         **********        (ADD$TO$A$B$PUMP$TIME AND ADD$TO$A$E$PUMP$TIME) ****
         **********        ARE DESIGNED TO TAKE CARE OF THIS PROBLEM BY *******
         **********        MAKING SURE ONE PUMP IS NOT TURNED ON UNTIL ********
         **********        THE OTHER PUMP IS TURNED OFF. **********************
         ******************************************************************/

         /******************************************************************
         ********** ADD TIME TO (A + B) PUMP ******************************
         ******************************************************************/

137  1   ADD$TO$A$B$PUMP$TIME: PROCEDURE (PUMP$TIME, DELAY) PUBLIC;

138  2     DECLARE (PUMP$TIME, DELAY) BYTE;

139  2     IF (A$B$PUMP$OFF = DORMANT) THEN      /* IS THE (A+B) PUMP OFF ? */
140  2       DO;                                 /* YES -- CHECK (A+E) PUMP */
141  3         IF (A$E$PUMP$OFF = DORMANT) THEN  /* IS THE (A+E) PUMP OFF?  */
142  3           DO;                             /* YES -- TURN ON (A+B)    */
143  4             A$B$PUMP$ON  = DELAY;
144  4             A$B$PUMP$OFF = PUMP$TIME + DELAY;
145  4           END;
             ELSE                                /* THE (A+E) PUMP IS ON!   */
146  3           DO;                             /* START (A+B) AT END (A+E)*/
147  4             A$B$PUMP$ON  = A$E$PUMP$OFF + 1;
148  4             A$B$PUMP$OFF = A$B$PUMP$ON  + PUMP$TIME;
149  4           END;
150  3       END;
           ELSE                                  /* (A+B) PUMP IS ALREADY ON*/
151  2       DO;                                 /* INCREASE PUMP ON TIME   */
152  3         A$B$PUMP$OFF = A$B$PUMP$OFF + PUMP$TIME;
153  3         IF (A$E$PUMP$ON <> DORMANT) AND (A$E$PUMP$ON <> QUEUED) THEN
154  3           DO;                             /* A+E IS WAITING FOR A+B  */
155  4             A$E$PUMP$ON  = A$E$PUMP$ON  + PUMP$TIME;
156  4             A$E$PUMP$OFF = A$E$PUMP$OFF + PUMP$TIME;
157  4           END;
158  3       END;
159  2     A$B$RUN$TIME = A$B$RUN$TIME + PUMP$TIME;
160  2     A$B$MDR$RUN$TIME = A$B$MDR$RUN$TIME + PUMP$TIME;
161  2     RETURN;
162  2   END ADD$TO$A$B$PUMP$TIME;
```

```
/*****************************************************************
********** ADD TIME TO FIXER PUMP ***********************************
*****************************************************************/

ADD$TO$FIXER$PUMP$TIME: PROCEDURE (PUMP$TIME, DELAY) PUBLIC;

  DECLARE (PUMP$TIME, DELAY) BYTE;

  IF (FIX$PUMP$OFF = DORMANT) THEN        /* IS THE FIXER PUMP OFF? */
    DO;                                   /* YES -- THEN TURN IT ON */
      FIX$PUMP$ON = DELAY;
      FIX$PUMP$OFF = PUMP$TIME + DELAY;
    END;
  ELSE
    DO;                                   /* NO -- RUN LONGER THEN  */
      FIX$PUMP$OFF = FIX$PUMP$OFF + PUMP$TIME;
    END;
  FIX$RUN$TIME = FIX$RUN$TIME + PUMP$TIME;
  RETURN;
END ADD$TO$FIXER$PUMP$TIME;


/*****************************************************************
********** ADD TIME TO (A + E) PUMP *********************************
*****************************************************************/

ADD$TO$A$E$PUMP$TIME: PROCEDURE (PUMP$TIME, DELAY) PUBLIC;

  DECLARE (PUMP$TIME, DELAY) BYTE;

  IF (A$E$PUMP$OFF = DORMANT) THEN      /* IS THE (A+E) PUMP OFF?  */
    DO;                                 /* YES -- CHECK A+B PUMP   */
      IF (A$B$PUMP$OFF = DORMANT) THEN  /* IS THE A+B PUMP OFF?    */
        DO;                             /* YES -- TURN ON A+E THEN */
          A$E$PUMP$ON  = DELAY;
          A$E$PUMP$OFF = PUMP$TIME + DELAY;
        END;
      ELSE
        DO;                             /* START A+E AT END OF A+B */
          A$E$PUMP$ON  = A$B$PUMP$OFF + 1;
          A$E$PUMP$OFF = A$E$PUMP$ON  + PUMP$TIME;
        END;
    END;
  ELSE
    DO;                                 /* A+E PUMP IS ALREADY ON! */
      A$E$PUMP$OFF = A$E$PUMP$OFF + PUMP$TIME;
      IF (A$B$PUMP$ON <> DORMANT) AND (A$B$PUMP$ON <> QUEUED) THEN
        DO;                             /* A+B IS WAITING FOR A+E  */
          A$B$PUMP$ON  = A$B$PUMP$ON  + PUMP$TIME;
          A$B$PUMP$OFF = A$B$PUMP$OFF + PUMP$TIME;
        END;
    END;
  A$E$RUN$TIME = A$E$RUN$TIME + PUMP$TIME;
  A$E$MDR$RUN$TIME = A$E$MDR$RUN$TIME + PUMP$TIME;
  RETURN;
END ADD$TO$A$E$PUMP$TIME;
```

```
/*****************************************************************
********** (A + B) PUMP CONTROL ROUTINES ****************************
*****************************************************************/

1   TURN$ON$A$B$PUMP: PROCEDURE PUBLIC;
2     CALL  LED$ON  (LED$A$B);        /* TURN ON (A + B) LED  */
2     CALL  PWR$ON  (PWR$A$B);        /* TURN ON (A + B) PUMP */
2     RETURN;
2   END TURN$ON$A$B$PUMP;

1   TURN$OFF$A$B$PUMP: PROCEDURE PUBLIC;
2     CALL  LED$OFF (LED$A$B);        /* TURN OFF (A + B) LED  */
2     CALL  PWR$OFF (PWR$A$B);        /* TURN OFF (A + B) PUMP */
2     RETURN;
2   END TURN$OFF$A$B$PUMP;


/*****************************************************************
********** FIXER PUMP CONTROL ROUTINES ******************************
*****************************************************************/

1   TURN$ON$FIX$PUMP: PROCEDURE PUBLIC;
2     CALL  LED$ON  (LED$FIXER);      /* TURN ON FIXER LED     */
2     CALL  PWR$ON  (PWR$FIXER);      /* TURN ON FIXER PUMP    */
2     RETURN;
2   END TURN$ON$FIX$PUMP;

1   TURN$OFF$FIX$PUMP: PROCEDURE PUBLIC;
2     CALL  LED$OFF (LED$FIXER);      /* TURN OFF FIXER LED    */
2     CALL  PWR$OFF (PWR$FIXER);      /* TURN OFF FIXER PUMP   */
2     RETURN;
2   END TURN$OFF$FIX$PUMP;
```

```
/*****************************************************************
********** GO INTO RUN MODE ***************************************
*****************************************************************/

GO$INTO$RUN$MODE: PROCEDURE PUBLIC;

  CALL  SET$UP$NEW$FILM$TYPE;        /* GO TO OLD DEVELOPMENT TIME        */
  IF MODE = PRE$STANDBY$MODE THEN    /* CAN ONLY GO INTO RUN MODE FROM    */
    DO;                              /* STANDBY MODE                      */
      CALL  WARN$ON(WARN$NOT$READY);   /* WE ARE NOT AT TEMP YET!         */
    END;
  ELSE                               /* LETS GO TO RUN MODE               */
    DO;
      MODE = RUN$MODE;               /* NOW WE ARE LEGALLY IN RUN MODE    */
    END;
  IF (NOT(KEYBOARD$ACTIVE)) THEN  KEY$TIME$OUT = QUEUED;  /* GO TO NEW DSPY */
  RETURN;
END GO$INTO$RUN$MODE;


/*****************************************************************
********** GO INTO STANDBY MODE ***********************************
*****************************************************************/

GO$INTO$STANDBY$MODE: PROCEDURE PUBLIC;

  IF (FILM$COUNT = 0) THEN        /* CAN OLNY GO INTO STANDBY MODE IF THERE */
    DO;                           /* IS NO FILM IN THE MACHINE!!!!          */
      IF NOT(MAIN$DRIVE$ENABLE) THEN  CALL WARN$ON(WARN$MAIN$DRIVE);
      ELSE
        DO;
          MODE = STANDBY$MODE;
          CALL  SET$UP$NEW$FILM$TYPE;
          IF NOT(KEYBOARD$ACTIVE) THEN KEY$TIME$OUT = QUEUED;
        END;
    END;
  ELSE                                /* FILM$COUNT <> 0                  */
    DO;                               /* MUST HAVE COME FROM PRE-STANDBY */
      MODE = RUN$MODE;                /* GO RIGHT TO RUN MODE !!!         */
    END;
  CALL  WARN$OFF(WARN$DEV$HEATING);   /* DEV NO LONGER HEATING            */
  CALL  WARN$OFF(WARN$NOT$READY);     /* DEV IS NOW READY FOR FILM        */
  RETURN;
END GO$INTO$STANDBY$MODE;
```

```
/*****************************************************************
********** CHECK THE FILM ENTRY SWITCH ******************************
*****************************************************************/

CHECK$FILM$ENTRY$SWITCH: PROCEDURE;
  IF(VALID$FILM = DORMANT) THEN                    /* IF WE ARE NOT VARIFYING */
    DO;                                            /* SEE IF THERE IS CHANGE  */
      IF (SWITCHES AND FILM$ENTRY) <> 0 THEN       /* IS THERE FILM ENTERING? */
        DO;                                        /* WAS IT ON LAST TIME? */
          IF FILM$ENTRY$DETECTED = FALSE THEN      /*  CHECK DETECTED FLAG */
            DO;                                    /*  IT WASN'T ON BEFORE */
              FILM$ENTRY$DETECTED = TRUE;          /*  SET EVENT FLAG      */
              CALL  TURN$OFF$SAFE$LAMP;            /*  KILL THE LIGHTS     */
              FILM$COUNT = FILM$COUNT + 1;         /*  ADD ONE TO FIL COUNT*/
              VALID$FILM = 30;                     /*  ONE INCH FILM CHECK */
              IF FILM$COUNT = 1 THEN  CALL  GO$INTO$RUN$MODE;
              IF ENTER$CALIBRATION$FILM THEN       /* IS THIS A CALIBRATION? */
                DO;                                /* YES IT IS              */
                  CAL$START = 4000;                /* START WHEN WE GET THERE*/
                END;
            END;
        END;
      ELSE                                     /* FILM ENTRY SWITCH IS OFF  */
        DO;                                    /* WAS IT TRUE LAST TIME?    */
          IF FILM$ENTRY$DETECTED = TRUE THEN       /* CHECK DETECTED FLAG */
            DO;                                    /* IT WAS ON BEFORE    */
              FILM$ENTRY$DETECTED = FALSE;         /* RESET EVENT FLAG    */
              CALL  PUT$FILM$INTO$TRACKING;        /* START TO TRACK FILM */
              SAFE$LAMP$ON = 80;                   /* TURN ON IN 3 INCHES */
              TOTAL$FILM = TOTAL$FILM + 1;         /* INCR. TOTAL PIECES  */
              IF (ENTER$CALIBRATION$FILM) AND (CAL$START <> DORMANT) THEN
                DO;                                /* END OF CALIBRATION FILM */
                  CAL$END = 4200;              /* OTHER SIDE OF SCANNER */
                  ENTER$CALIBRATION$FILM = FALSE;
                END;
            END;
        END;
    END;
  RETURN;
END CHECK$FILM$ENTRY$SWITCH;

/*****************************************************************
********** PUT FILM INTO TRACKING ARRAY *****************************
*****************************************************************/

PUT$FILM$INTO$TRACKING: PROCEDURE PUBLIC;
  TRACKING$COUNT = TRACKING$COUNT + 1;        /* INCR. TRACKING COUNTER */
  FILM$POSITION(TRACKING$COUNT-1) = FILM$PATH(0).POSITION;
  FILM$IN$DEV = TRUE;                         /* SET FILM IN DEV FLAG   */
  TIME$LEFT$IN$DEV = FILM$PATH(0).POSITION - FILM$PATH(2).POSITION;
  RETURN;
END PUT$FILM$INTO$TRACKING;
```

```
/*****************************************************************
********** FILM TRACKING (WHAT BATH IS THE FILM IN) ****************
*****************************************************************/

124  1   FILM$TRACKING: PROCEDURE PUBLIC;
125  2     DECLARE (INDEX, COUNT) BYTE;
126  2     IF (TRACKING$COUNT <> 0) THEN
127  2       DO;                                  /* THERE IS FILM! */
128  3         DO INDEX = 1 TO TRACKING$COUNT;
129  4           FILM$POSITION(INDEX-1) = FILM$POSITION(INDEX-1) - 1;
130  4         END;
131  3         DO WHILE ((FILM$POSITION(0) = 0) AND (TRACKING$COUNT <> 0));
132  4           DO INDEX = 2 TO TRACKING$COUNT;
133  5             FILM$POSITION(INDEX-2) = FILM$POSITION(INDEX-1);
134  5           END;                             /* FILM HAS EXITED */
135  4           TRACKING$COUNT = TRACKING$COUNT - 1;/* ONE LESS TO WORRY ABOUT */
136  4           FILM$COUNT = FILM$COUNT - 1;     /* KEEP TRACK OF FILM COUNT */
137  4           IF (FILM$COUNT = 0) THEN  CALL  GO$INTO$STANDBY$MODE;
139  4         END;
140  3         FILM$OUTPUT = 0;                   /* START WITH NO FILM */
141  3         COUNT = TRACKING$COUNT;            /* SCAN ALL FILM */
142  3         INDEX = 0;                         /* SET UP FILM PATH INDEX */
143  3         DO WHILE (COUNT <> 0);             /* LET'S LOOK THRU TABLE */
144  4           IF (FILM$POSITION(COUNT-1) <= FILM$PATH(INDEX).POSITION) AND
                   (FILM$POSITION(COUNT-1) >  FILM$PATH(INDEX+1).POSITION) THEN
145  4             DO;
146  5               FILM$OUTPUT = (FILM$OUTPUT) OR (FILM$PATH(INDEX).LOCATION);
147  5               COUNT = COUNT - 1;
148  5             END;
                 ELSE
149  4             DO;
150  5               INDEX = INDEX + 1;
151  5             END;
152  4           END;
153  3         CALL  LED$OFF ((LED$TRACKING AND (NOT (FILM$OUTPUT))));
154  3         CALL  LED$ON  (FILM$OUTPUT);
155  3         IF (TRACKING$COUNT <> 0) AND
                 (FILM$POSITION(TRACKING$COUNT-1) > FILM$PATH(2).POSITION) THEN
156  3           DO;
157  4             FILM$IN$DEV = TRUE;
158  4             TIME$LEFT$IN$DEV=FILM$POSITION(TRACKING$COUNT-1)-FILM$PATH(2).POSITION;
159  4           END;
                 ELSE
160  3           DO;
161  4             FILM$IN$DEV = FALSE;
162  4           END;
163  3         IF ((TRACKING$COUNT <> 0) AND
                   (FILM$POSITION(0) < FILM$PATH(4).POSITION)) THEN
164  3           FILM$IN$DRY = TRUE;
                 ELSE
165  3           FILM$IN$DRY = FALSE;
166  3       END;
167  2       RETURN;
168  2     END FILM$TRACKING;
```

```
/*********************************************************/
/***** CALCULATE THE ACTUAL TRIP POINT. ******************/
/*********************************************************/

231  2    ACTUAL$TRIP$POINT = (FILM$TYPE(NEXT).TRIP$POINT * CALIBRATION$POINT) / 50;

/*********************************************************/
/***** SET UP DRYER TEMPERATURE CONTROL VARIABLES.   *****/
/*********************************************************/

232  2    IF (CONSERVE$BLOWER) AND (FILM$COUNT = 0) THEN
233  2      DO;                    /* TURN OFF THE BLOWER */
234  3        IF DRY$CONTROL$ACTIVE THEN
235  3          DO;
236  4            DRY$CONTROL$ACTIVE = FALSE;
237  4            DRY$HEAT$OFF = QUEUED;
238  4            BLOWER$OFF = 30;
239  4            CALL  WARN$OFF(WARN$DRYER);
240  4          END;
241  3      END;
         ELSE
242  2      DO;
243  3        IF DRY$HEAT$ENABLE THEN  BLOWER$ON = QUEUED;
245  3        ELSE                     CALL  WARN$ON(WARN$DRYER);
246  3      END;

258  2    CALL  TRANSFER$FILM$TYPE(NEXT, CURRENT);

259  2    IF FILM$TYPE(NEXT).DEV$TIME = 480 THEN              /* SBY SPEED? */
260  2      FILM$TYPE(NEXT).DEV$TIME = CURRENT$DEV$TIME;      /* RESTORE OLD VALUE */
261  2    RETURN;
262  2  END SET$UP$NEW$FILM$TYPE;
```

What is claimed is:

1. In a film processor including a scanner arrangement having a light source and a photodetector responsive to the intensity of the light source for generating a reference background level signal representative of the intensity of the output of the scanner arrangement when no film is interposed between the photodetector and the source, the reference background level being useful as a standard against which the transmissivity of processed film is determined, wherein the improvement comprises:

a reference background level monitoring network for tracking the reference background level signal output from the photodetector and for compensating for a fluctuation in the source by generating an adjusted reference background level functionally related to the weighted average of the instantaneous reference background level signal and a previous reference background level signal.

2. The film processor of claim 1, wherein the processor is operable in a processing mode and in a standby mode, and wherein the sum of the instantaneous photodetector output and a previous reference background level signal is weighted in accordance with the mode of the processor.

3. The film processor of claims 1 or 2, wherein the network comprises a firmware-based microcomputer.

4. In a film processor including film transport rollers driveable by a drive motor at a predetermined transport speed, a sensor for generating a signal representative of the transport speed, and a film density detector arrangement having a light source and a photodetector responsive to the intensity of the light source for generating a reference background level signal representative of the output of the scanner arrangement when no film is present between the photodetector and the source, the reference background signal being useful as a standard against which the transmissivity of processed film is determined, wherein the improvement comprises a reference background level monitoring network itself comprising:

an enable signal generator responsive to the signal representative of the transport speed for periodically generating a reference background update enable signal; and, an adjusted reference background signal generator responsive to the background update enable signal for generating an adjusted reference background level signal; functionally related to the weighted sum of the instantaneous photodetector level signal sampled in response to the generation of a predetermined background update enable signal; and of the previous reference background level signal sample upon the generation of a previous background update enable signal.

5. The film processor of claim 4, wherein the processor is operable in a processing mode and in a standby mode, and wherein the sum of the current and a previous reference background level signals is weighted in accordance with the mode of the processor.

6. The film processor of claim 5, wherein the processor is operable in a processing mode and in a standby mode respectively indicative of the presence or absence of film within the processor and wherein the processor includes means for generating a signal representative of the entry of a film into the processor and of the exit of a film from the processor, and wherein the reference background level monitoring network further comprises:

means responsive to the film entry signal and to the film exit signal for generating a signal representative of the operating mode of the processor; and wherein the adjusted reference background signal generator is responsive to the processor operating mode signal for weighting the average of the instantaneous and a previous reference background level in accordance with the operating mode of the processor.

7. The film processor of claims 4, 5 or 6 wherein the background level monitoring network comprises a firmware-based microcomputer.

8. In a film processor operable in a standby and in a run mode which includes film transport rollers driveable by a drive motor at a predetermined transport speed, a sensor for generating a signal representative of the transport speed, and a film density detector arrangement having a light source and a photodetector responsive to the intensity of the light source for generating a reference background level signal representative of the output of the density detector arrangement when no film is present between the photodetector and the source, the reference background level signal being useful as a standard against which the transmissivity of processed film is determined, wherein the improvement comprises a photodetector signal level monitoring network itself comprising:

an enable signal generator responsive to the signal representative of the transport speed and to a signal representative of the mode of the processor for periodically generating a reference background update enable signal, an adjusted reference background signal generator responsive to the background update enable signal for generating an adjusted reference background level signal functionally related to the weighted average of the instantaneous photodetector signal level signal sampled in response to the generating of a predetermined background update enable signal and of the reference background level signal sampled upon the generation of a previous background update enable signal.

9. The film processor of claim 8, wherein the processor is operable in a processing mode and in a standby mode, and wherein the average of the instantaneous photodetector signal level and a previous reference background level signal is weighted in accordance with the mode of the processor.

10. The film processor of claim 9, wherein the processor is operable in a processing mode and in a standby mode respectively indicative of the presence or absence of film within the processor and wherein the processor includes means for generating a signal representative of the entry of a film into the processor and of the exit of a film from the processor, and wherein the reference background level monitoring network further comprises:

means responsive to the film entry signal and to the film exit signal for generating a signal representative of the operating mode of the processor; and wherein the adjusted reference background signal generator is responsive to the processor operating mode signal for weighting the average of the instantaneous photodetector signal level and a previous reference background signal in accordance with the operating mode of the processor.

11. The film processor of claims 8, 9 and 10 wherein the background level monitoring network comprises a firmware-based microcomputer.

12. A method for compensating for fluctuations in a film density detector arrangement output in a film processor operable in a processing mode and in a standby mode, comprising the steps of:

(a) periodically sampling the background level signal output of the photodetectors;

(b) generating an updated reference background signal functionally related to the weighted average of a sampled background signal level and of a reference background signal level sampled at a time previous thereto.

13. The method of claim 12 wherein the processor is operable at a predetermined transport speed and wherein the step (a) is performed at a frequency functionally related to the transport speed.

14. The method of claims 12 or 13 wherein the step (b) is performed by weighting the sum in accordance with the processing mode of the processor.

* * * * *